US005480023A

United States Patent [19]

Puller

[11] Patent Number: 5,480,023

[45] Date of Patent: Jan. 2, 1996

[54] BASEBALL CAP CARRYING BAG

[76] Inventor: Alonzo L. Puller, P.O. Box 891, Charles Town, W. Va. 25414

[21] Appl. No.: 338,121

[22] Filed: Nov. 9, 1994

[51] Int. Cl.[6] ..... A45C 11/02; A45C 13/04; B65D 85/18

[52] U.S. Cl. ..... 206/8; 206/280; 190/13 G; 190/103; 190/127

[58] Field of Search ..... 190/13 G, 103, 190/127; 206/8, 9, 280, 272; 2/46

[56] References Cited

U.S. PATENT DOCUMENTS

| | | | |
|---|---|---|---|
| 633,864 | 9/1899 | Lindsey . | |
| 1,028,168 | 6/1912 | Williams | 190/127 |
| 1,233,784 | 7/1917 | Hutchison | 383/18 X |
| 1,615,780 | 1/1927 | Wesala | 2/46 |
| 1,647,679 | 11/1927 | Williams | 206/8 |
| 1,691,904 | 11/1928 | Gamble | 206/8 |
| 1,730,898 | 10/1929 | Percival | 206/8 |
| 1,902,313 | 3/1933 | Struble . | |
| 2,136,744 | 11/1938 | Huye | 206/8 |
| 2,655,256 | 10/1953 | Guest | 2/46 X |
| 2,659,481 | 11/1953 | Jones | 206/8 |
| 3,402,807 | 9/1968 | Hatcher, Jr. | 206/8 |
| 3,469,264 | 9/1969 | Harris | 2/46 |
| 4,985,721 | 1/1991 | Moon | 190/127 X |
| 5,022,515 | 6/1991 | Agostine | 206/8 |
| 5,251,731 | 10/1993 | Cassese et al. | 190/103 |
| 5,273,298 | 12/1993 | Brown, Sr. | 206/315.1 X |

FOREIGN PATENT DOCUMENTS

| | | | |
|---|---|---|---|
| 262585 | 12/1926 | United Kingdom | 206/8 |
| 416448 | 9/1934 | United Kingdom | 206/8 |

*Primary Examiner*—Sue A. Weaver
*Attorney, Agent, or Firm*—Richard C. Litman

[57] ABSTRACT

A cap container includes an elongated container body, a bill container body joined to the elongated container body, and an adjustable frame disposed within the elongated container body. The elongated container body has a front end, rear end, and a wall extending from the front end to the rear end. The wall is made of a supple material, such as cloth, and defines an elongated chamber within the elongated container body. The bill container body defines a cavity which together with the elongated chamber of the elongated container body allow for the compact storage of visored, baseball-type caps in a shingled arrangement. The frame prevents the caps from being crushed and also supports the supple wall. The supple wall in conjunction with the adjustable frame allows the length of the container to vary in order to accommodate the storage of varying numbers of caps. The adjustable nature of container ensures optimum utilization of available storage space. As the number of caps stored in the container is reduced, the volume occupied by the container may also be reduced. The outer surface of the bill container body includes a cloth covered surface which resembles the bill and convex front portion of a baseball cap. The material and decorative design of the outer surface may be selected to match the design of the caps stored in the container.

7 Claims, 4 Drawing Sheets

BASEBALL CAP CARRYING BAG

BACKGROUND OF THE INVENTION

1. Field of the Invention

The present invention relates to containers for holding, storing, and transporting caps. It relates more specifically to containers for caps which are commonly known and referred to as baseball caps.

2. Description of the Prior Art

It is known to hold, contain, and store hats and caps in containers. Many of these prior art containers allow caps to be stacked vertically within the container. Such containers typically fail to provide for the compact storage of the caps, and tend to be bulky and cumbersome. Some prior art cap containers do provide for the compact storage of caps. However, such containers typically have rigid walls which prevent the convenient adjustment of the length of the container. A container which could be conveniently adjusted in length would accommodate varying numbers of caps and ensure that the container itself would occupy only the minimum amount of space needed to hold or carry the caps.

U.S. Pat. No. 633,864, issued to H. F. Lindsey on Sep. 26, 1899, discloses a Hanging Compartment Hat Box which includes a plurality of compartments. The compartments are disposed one on top of another and hingedly connected to each other.

U.S. Pat. No. 1,902,313, issued to Mabel Struble on Mar. 21, 1933, discloses a Hat Box which includes parallel oval end pieces and a side member curved to oval form connecting the end pieces. The side member has a door opening and a door adapted to close the opening. The Hat Box also includes a plurality of circular hat retaining members disposed in an inclined position within the interior of the Hat Box.

U.S. Pat. No. 2,136,744, issued to Joseph G. Huye on Nov. 15, 1938, discloses a Hat Packing Stay and Combination Package which includes a box with a tubular body. A top and bottom close the upper and lower ends respectively of the tubular body. A plurality of hat centering and spacing means are disposed within the tubular housing. The hat centering and spacing means are arranged in alteration with a plurality of hats to form a stack within the tubular housing.

U.S. Pat. No. 3,402,807, issued to Robert Hatcher on Sep. 24, 1968, discloses a Hat Box and Hat Support which includes an oval shaped base arranged to engage uniformly the bottom surface of the brim of a hat. A boss, centrally disposed on the base, extends upwardly into the crown of the hat. The device of the '807 patent also includes a plurality of forms. Each form has tubular portion and an outwardly and peripherally extending flange carried intermediate the upper and lower ends. A tubular carrying case is provided for receiving the base, a plurality of hats, and a plurality of forms.

U.S. Pat. No. 5,022,515, issued to Anthony Agostine on Jun. 11, 1991, discloses a Hat Container which includes outer walls defining a body and bill. The outer walls also define a space having a main body chamber and a bill-shaped chamber. The main body chamber is adapted to receive one or more billed hats. The bill-shaped chamber is adapted to receive the corresponding bills of the billed hats. The outer walls must be constructed of a material whereby these walls are relatively rigid and sturdy to protect the hats in normal storage situations.

U.S. Pat. No. 5,273,298, issued to Donald C. Brown on Dec. 28, 1993, discloses a Combined Carrier and Storage Device for Baseball or Softball Team Equipment. The carrier of the '298 patent includes two separate enclosures which are detachably combined. The carrier is wheeled for easy transport.

None of the above inventions and patents, taken either singly or in combination, is seen to describe the instant invention as claimed.

SUMMARY OF THE INVENTION

The cap container of the present invention provides a container which conforms to the shape of a baseball cap. The cap container includes an elongated container body, a bill container body joined to the elongated container body, and an adjustable frame disposed within the elongated container body. The elongated container body has a front end, rear end, and a wall extending from the front end to the rear end. The wall is made of a supple material, such as cloth, and defines an elongated chamber within the elongated container body. The bill container body defines a cavity which together with the elongated chamber of the elongated container body allow for the compact storage of baseball caps in a shingled arrangement.

The frame prevents the caps from being crushed and supports the supple wall. The supple wall in conjunction with the adjustable frame allow the length of the container to vary in order to accommodate the storage of varying number of caps. The adjustable nature of container ensures optimum utilization of available storage space. As the number of caps stored in the container is reduced, the volume occupied by the container may also be reduced.

The outer surface of the bill container body includes a cloth covered surface which resembles the bill and convex front portion of a baseball cap. The material and decorative design of the outer surface may be selected to match the design of the caps stored in the container.

Accordingly, it is a principal object of the invention to provide a container for compact storage of caps arranged in a shingled array.

It is another object of the invention to provide an elongated cap storage container which may be adjusted in length to accommodate varying numbers of caps.

It is a further object of the invention to provide a cap container having a decorative cloth front portion closely resembling the front portion of a cap stored in the container.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
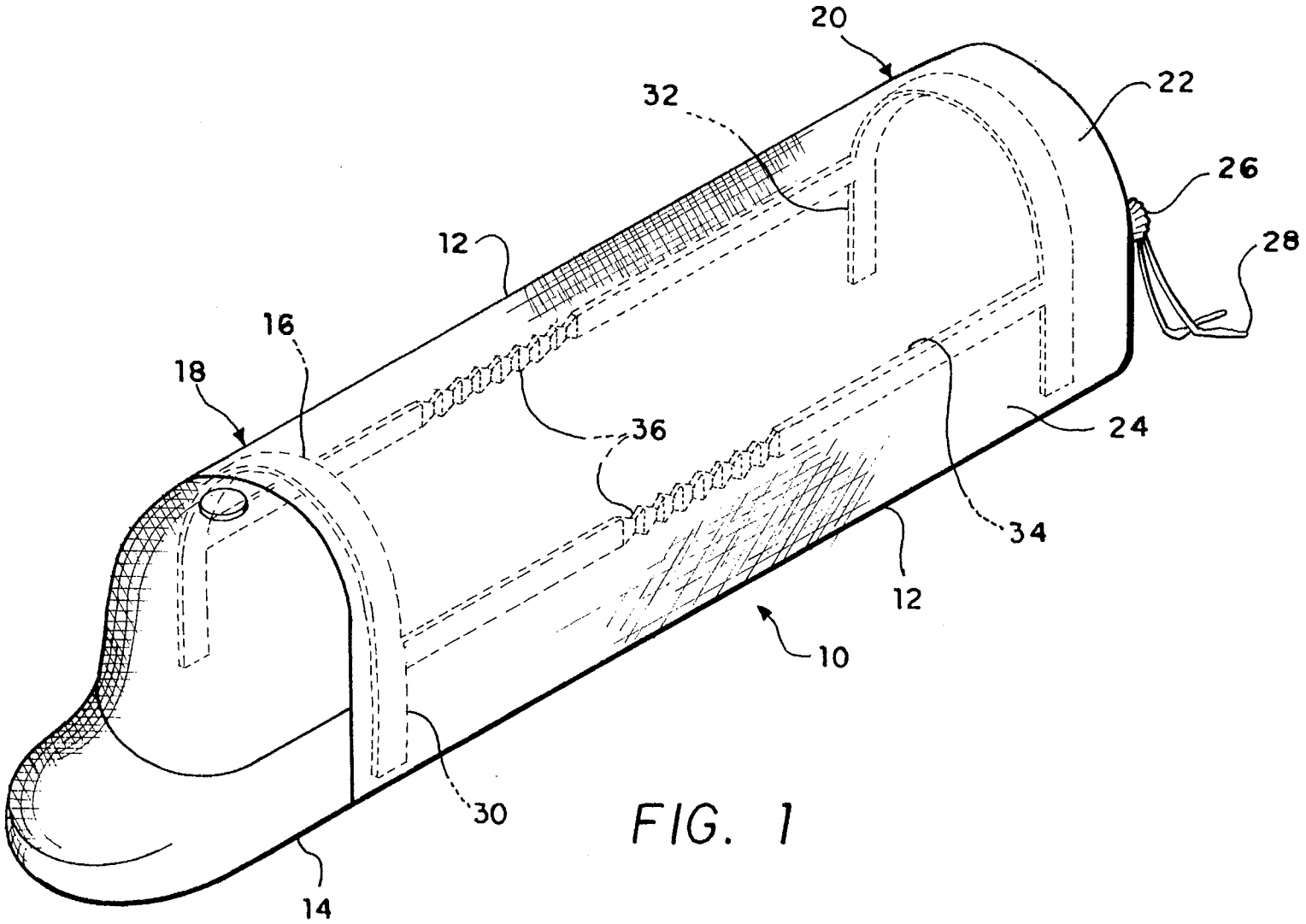
FIG. 1 is a perspective view of the cap container of the present invention.

Referring now to the drawings and in particular to FIG. 1, the cap storage container 10 of the present invention includes an elongated container body 12, a bill container body 14 joined to the elongated container body 12, and a frame 16 disposed within the elongated container body 12. The elongated container body 12 has a front end 18, rear end 20, and a wall 22 extending from the front end 18 to the rear end 20. The wall 22, made of a supple material such as cloth, defines an elongated chamber 24 within the elongated container body 12.

Figure 2:
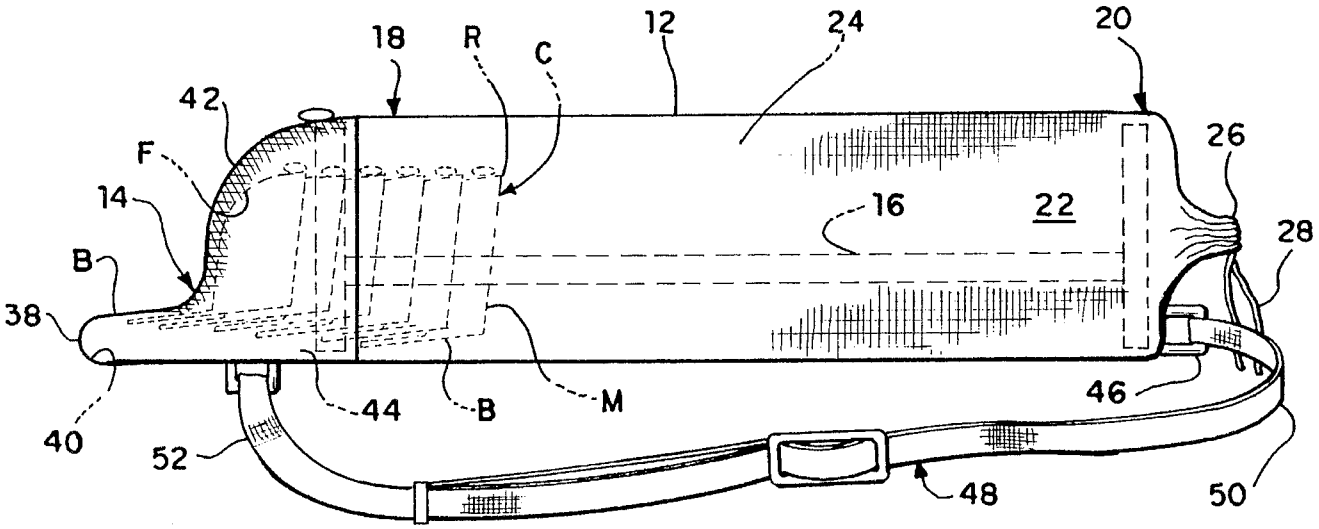
FIG. 2 is an side elevational view thereof showing the a plurality of caps disposed within the cap container in a shingled arrangement.

As shown in FIG. 2, the elongated chamber 24 is dimensioned to receive a plurality of caps C. Each of the plurality of caps C includes a main body portion M having a length and a width, and a bill B. In storing the caps C, the rear segments R of the main body portions M are folded forwardly into the front segments F of the main body portions M, thereby collapsing the main body portion. The plurality of caps C are arranged such that the collapsed main body portions are arranged from front to rear in a shingled array. The bills B are arranged in a front-to-rear shingled array corresponding to the arrangement of the main body portions M.

Figure 3:
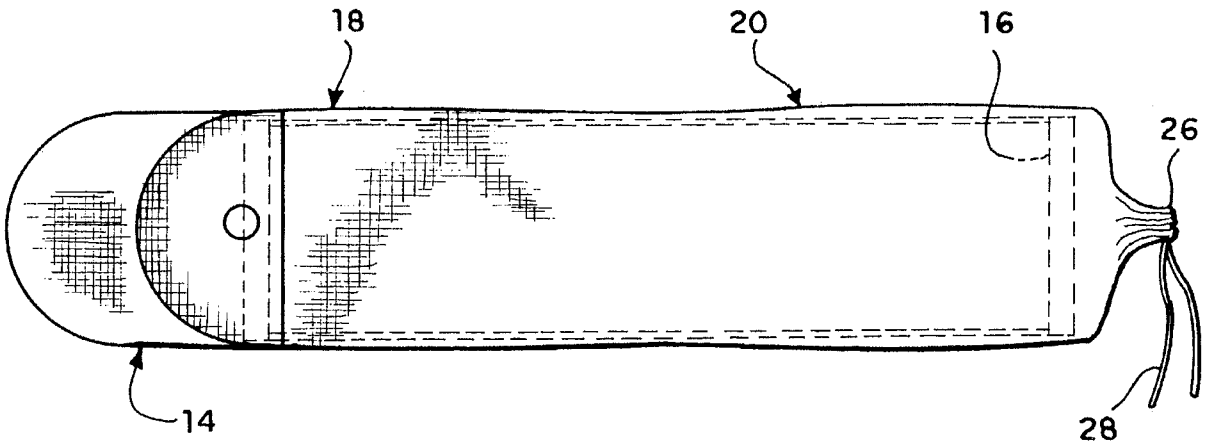
FIG. 3 is a top plan view of the cap container.

As shown in FIGS. 2 and 3, the rear end 20 includes a pouch-like opening 26 dimensioned for insertion of the plurality of caps C into the elongated chamber 24. A simple drawstring closure 28 is provided to close the opening 26.

Figure 7:
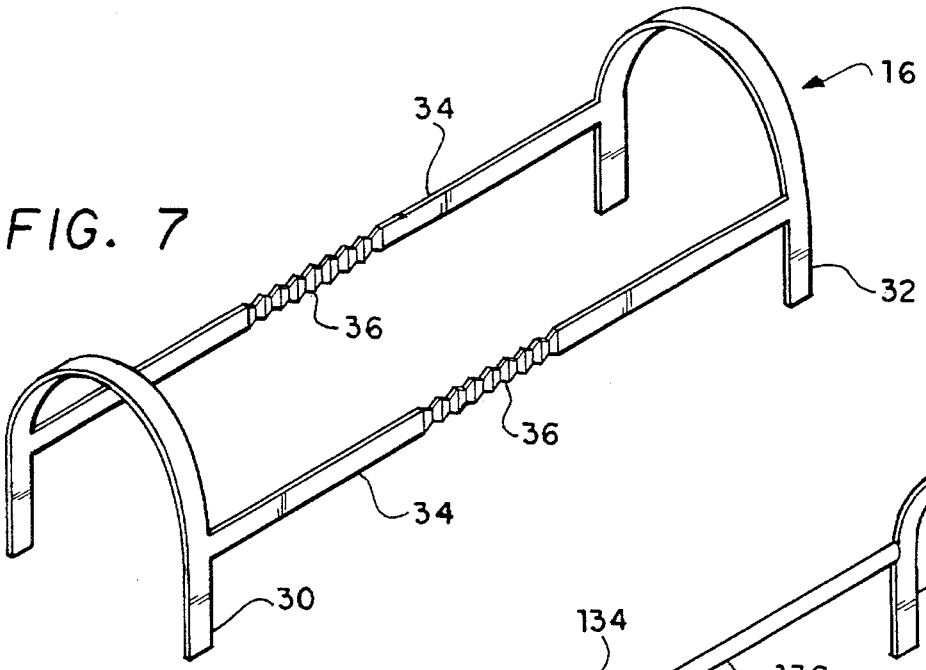
FIG. 7 is a perspective view of a frame member of the cap container shown removed and apart from the cap container.

The frame 16 disposed within the elongated chamber 24 supports the supple and otherwise collapsible wall 22 of the elongated container body 12. The frame 16 is dimensioned to allow for through-passage of the plurality of caps C and also prevents the crushing of the caps C stored within the elongated chamber 24. As best shown in FIG. 7, the frame 16 includes an arched front frame member 30, an arched rear frame member 32, and a pair of lateral frame members 34. The front frame member 30 and rear frame member 32 are disposed adjacent the front end 18 and rear end 20, respectively, of the elongated container body 12. The lateral frame members 34 are spaced apart, with each extending from the front frame member 30 to the rear frame member 32. As shown in FIG. 7, each lateral frame member 34 includes a section 36 having an accordion-like configuration. The accordion-like section 36 may be expanded or compressed to increase or decrease the overall length of the frame member 16.

Returning now to FIG. 2, the bill container body 14 extends from the front end 18 of the elongated container body 12. The bill container body 14 includes a bill container front surface 38 constructed of cloth, and a bill container back surface 40. A portion 42 of the bill container front surface 38 has a convex shape whereby the cloth covered container bill front surface 38 has an overall decorative appearance resembling the front portion of a baseball cap, for example.

The bill container back surface 40 defines a bill-receiving chamber 44 cooperatively shaped like the bill of a baseball cap. The bill-receiving chamber 44 is dimensioned to receive the front-to-rear shingled array of bills corresponding to the collapsed arrangement of the main body portions M of the plurality of caps C stored in the elongated chamber 24 of the elongated container body 12.

With further reference to FIG. 2, to facilitate easy transport of the cap container, a hook member 46 is attached to the rear end 20 of the elongated container body 12. Additionally, a strap member 48 is provided. The strap member 48 includes a first strap end 50 attached to the rear end 20 of the elongated container body 12 and a second strap end 52 attached to the front end 18 of the elongated container body 12.

Figure 8:
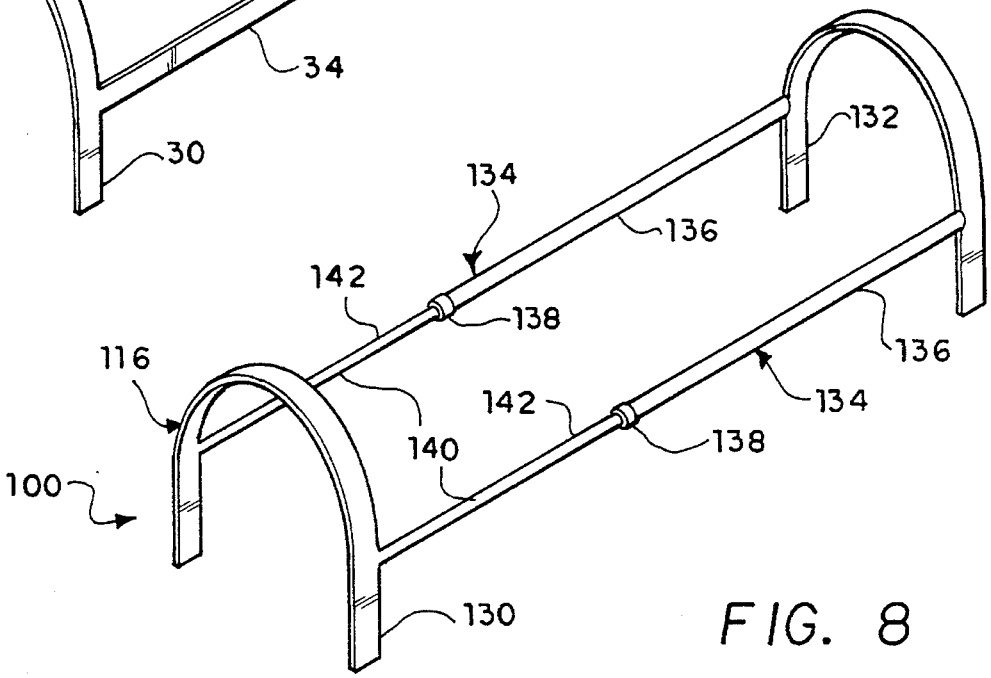
FIG. 8 is a perspective view of an alternative embodiment of the frame member.

An alternative embodiment internal support 100 in place of frame 16 is shown in FIG. 8. The frame 116 of this configuration includes an arched front frame member 130, an arched rear frame member 132, and a pair of lateral frame members 134 similar to the front frame member 30, rear frame member 32, and lateral frame members 34 respectively of the frame 16 of the FIG. 7 embodiment. Each lateral frame member 134 includes a tubular member 136 which extend from the rear frame end 132 to terminate in an open end 138. Each lateral frame member 134 also includes a rod member 140 which extends from the front frame end 130 to terminate in a free end 142. The free ends 142 are telescopically mounted within the open ends 138 of the tubular member 136 to allow telescopic adjustment of the overall length of the frame 116 within the elongated container body 12.

Figure 4:
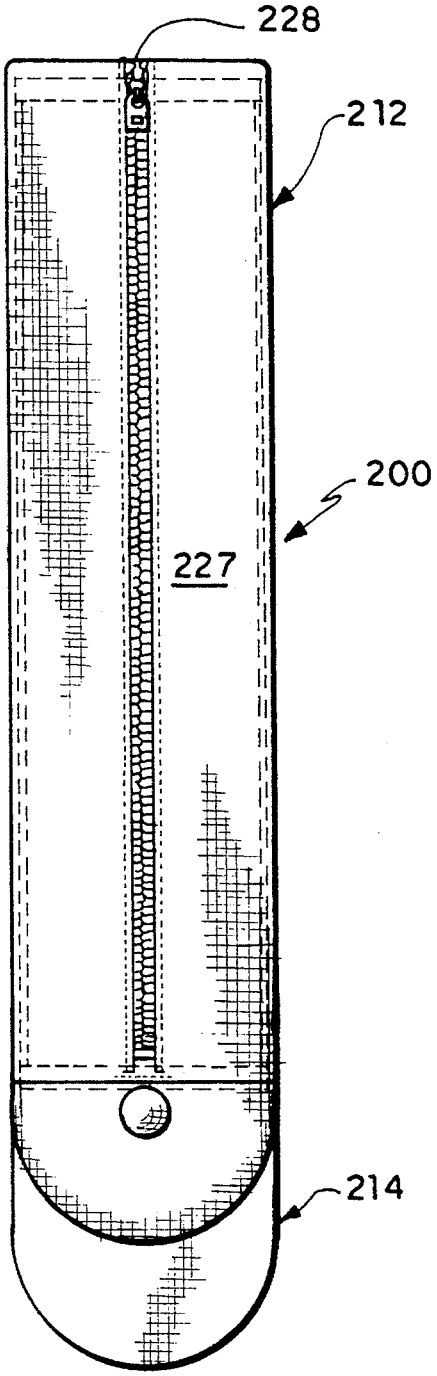
FIG. 4 is a top plan view of an alternative embodiment of a cap container showing the zipper closure in a closed position.
Figure 5:
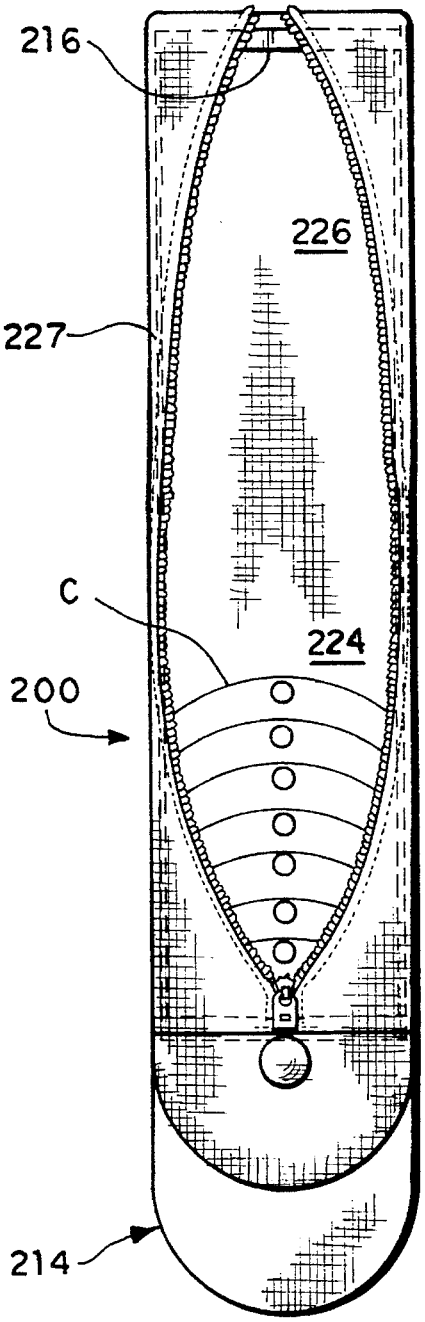
FIG. 5 is top plan view of the alternative embodiment with the zipper closure opened to display a plurality of caps within the cap container.

An alternative embodiment of the cap container is shown in FIG. 4 and 5. The cap container 200 of this embodiment includes an elongated container body 212 and a bill container body 214 similar to the elongated container body 12 and bill container body 14, respectively, of the preferred embodiment. The cap container 200 also includes a frame 216 similar to either the preferred embodiment of the frame 16 as shown in FIG. 7 or the alternative embodiment of the frame 116 as shown in FIG. 8. Additionally, the cap container 200 of the alternative embodiment includes an opening 226 which extends along the length of a upper portion 227 of the elongated container body 212. This opening 226 is dimensioned for insertion of the plurality of caps C into the elongated chamber 224. A zipper closure 228 is provided for the opening 226.

Figure 6:
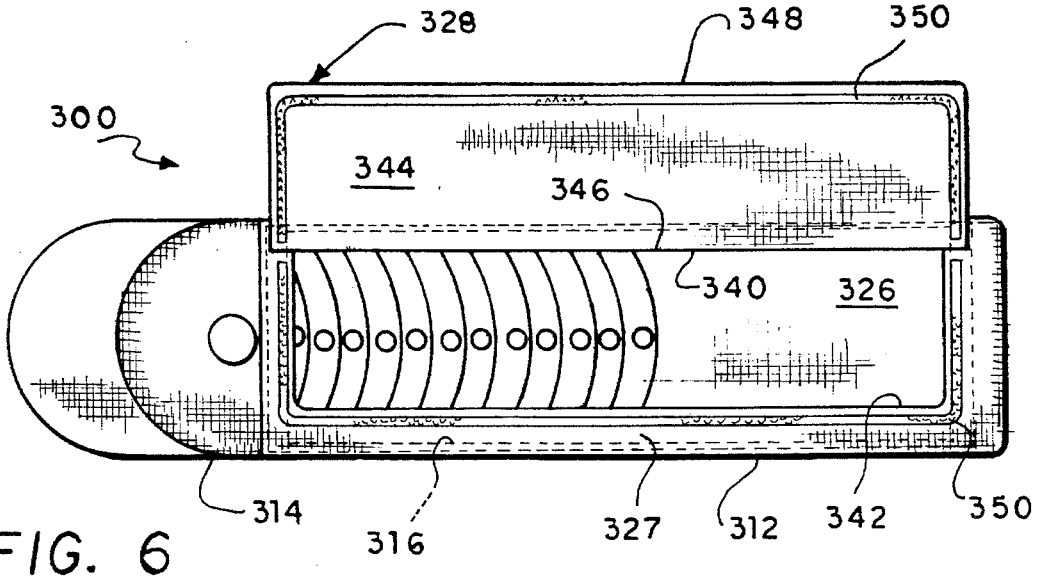
FIG. 6 is a top plan view of a third embodiment showing a flap closure in an open position to display a plurality of caps within the cap container.

A third embodiment of the cap container is shown in FIG. 6. The cap container 300 of the third embodiment includes an elongated container body 312 and a bill container body 314 similar to the elongated container body 12 and bill container body 14, respectively, of the preferred embodiment. The cap container 300 also includes a frame 31 similar to either the preferred embodiment of the frame 16 as shown in FIG. 7 or the alternative embodiment of the frame 116 as shown in FIG. 8. Additionally, the cap container of the third embodiment includes an opening 326, which extends along the length of a upper portion 327 of the elongated container body 312, and a corresponding closure 328. The opening 326 includes a first edge 340 and opposing second edge 342. The closure 328 includes a flap member 344. The flap member 344 includes a flap first edge 346 and an opposing flap second edge 348. The flap first edge 346 defines a fold line for the flap member 344 along the first edge 340. The opposing flap second edge 348 overlaps the second edge 342 of the opening 326 when the flap is in the closed position. Portions of hook and loop fasteners 350 are attached to both the flap second edge 348 and the second edge 342 of the opening 326 to provide for removable securement of the flap 344 in the closed position.

It is to be understood that the present invention is not limited to the embodiments described above, but encompasses any and all embodiments within the scope of the following claims.

What is claimed is:

1. A cap storage container for receiving a plurality of caps, each of the plurality of caps including a main body portion and a bill, the plurality of caps being arranged in a front-to-rear shingled array, said cap storage container comprising:

an elongated container body having a front end, rear end, and a wall extending from said front end to said rear end, said wall constructed from a supple material and defining an elongated chamber dimensioned to receive the plurality of caps, said elongated container body including an opening for insertion of the plurality of caps;

a frame disposed within said elongated chamber, said frame supporting said wall of said elongated container body and preventing the crushing of the plurality of caps stored within said elongated chamber, said frame having a front frame member adjacent said front end of said elongated container body, a rear frame member located adjacent said rear end of said elongated container body, and a lateral frame member extending from said front frame member to said rear frame member; and a bill container body extending from said front end of said elongated container body, said bill container body having a bill container front surface constructed of cloth and a bill container back surface defining a bill-receiving chamber, a portion of said bill container front surface having a convex shape, whereby said bill container front surface resembles a convex front surface of a visored cap.

2. The cap storage container according to claim 1, wherein said opening includes a drawstring closure at said rear end of said elongated container body.

3. The cap storage container according to claim 1, wherein said opening includes a zipper closure at an upper portion of said elongated container body.

4. The cap storage container according to claim 1, wherein said opening has a first edge and opposing second edge at an upper portion of said elongated container body, said opening including a closure, said closure having a flap member, said flap member having a first flap edge and an opposing second flap edge, said first flap edge and said opening first edge defining a fold line, said opposing second flap edge overlapping said second edge of said opening and being removably secured thereto.

5. The cap storage container according to claim 1, wherein said lateral frame member includes a section having an accordion-like configuration, whereby said accordion-like section may be expanded and compressed to increase and decrease the overall length of said frame member.

6. The cap storage container according to claim 1, wherein said lateral frame member includes a tubular member extending from said front frame member and terminating in an open end, and a rod member extending from said rear frame member and terminating in a free end, said free end being telescopically interfitted within said open end of said tubular member, whereby said lateral frame member may be expanded and contracted to increase and decrease the overall length of said lateral frame member.

7. A cap storage container for receiving a plurality of caps, each of the plurality of caps including a main body portion and a bill, the plurality of caps being arranged in a front-to-rear shingled array, said cap storage container comprising:

an elongated container body having a front end, rear end, and a wall extending from said front end to said rear end, said wall constructed from a supple material and defining an elongated chamber dimensioned to receive the plurality of caps, said elongated container body having an opening dimensioned for insertion of a plurality of caps into said elongated chamber, said opening including a drawstring closure;

a frame disposed within said elongated chamber, said frame supporting said wall of said elongated container body and preventing the crushing of the plurality of caps stored within said elongated chamber, said frame having a front frame member adjacent said front end of said elongated container body, a rear frame member located adjacent said rear end of said elongated container body, and a lateral frame member extending from said front frame member to said rear frame member, said lateral frame member including a section having an accordion-like configuration, whereby said section may be expanded and compressed to increase and decrease the overall length of said frame member, said frame being dimensioned for through-passage of the plurality of caps;

a bill container body extending from said front end of said elongated container body, said bill container body having a bill container front surface constructed of cloth and a bill container back surface defining a bill-receiving chamber, a portion of said bill container front surface having a convex shape, whereby said bill container front surface resembles the convex front surface of a visored cap;

a hook member attached to said rear end of said elongated container body; and a strap member having a first strap end attached to said rear end of said elongated container body and a second strap end attached to said front end of said elongated container body.

* * * * *